US010368161B2

(12) United States Patent
Liu et al.

(10) Patent No.: US 10,368,161 B2
(45) Date of Patent: Jul. 30, 2019

(54) AMPLIFIER AND ELECTRONIC DEVICE USING THE SAME

(71) Applicant: Acer Incorporated, New Taipei (TW)

(72) Inventors: Feng-Ming Liu, New Taipei (TW); Jia-Ren Chang, New Taipei (TW); Chien-Chung Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/418,890

(22) Filed: Jan. 30, 2017

(65) Prior Publication Data

US 2017/0374452 A1 Dec. 28, 2017

(30) Foreign Application Priority Data

Jun. 24, 2016 (TW) ..... 105119941 A

(51) Int. Cl.
*H04R 1/28* (2006.01)
*H04R 1/02* (2006.01)
*H04R 3/12* (2006.01)

(52) U.S. Cl.
CPC ..... *H04R 1/2888* (2013.01); *H04R 1/025* (2013.01); *H04R 3/12* (2013.01); *H04R 2201/028* (2013.01)

(58) Field of Classification Search
CPC .... H04R 1/2888; H04R 1/2884; H04R 1/025; H04R 3/12; H04R 2201/02; H04R 2201/028
USPC ..... 381/355
See application file for complete search history.

(56) References Cited

U.S. PATENT DOCUMENTS 2,632,055 A * 3/1953 Parker ..... H04R 1/227 181/145
4,837,826 A * 6/1989 Schupbach ..... H04R 1/403 181/145
5,222,145 A * 6/1993 Draffen ..... H04R 5/02 181/145
5,546,468 A * 8/1996 Beard ..... B60R 11/0217 181/145
6,411,720 B1 * 6/2002 Pritchard ..... H04R 1/2857 181/156
7,103,393 B2 * 9/2006 Hwang ..... H04M 1/6016 455/550.1

(Continued)

FOREIGN PATENT DOCUMENTS

CN 1720760 A 1/2006
CN 101453678 A 6/2009

(Continued)

OTHER PUBLICATIONS

TW Office Action dated Oct. 31, 2017 in corresponding Taiwan application (No. 105119941).

(Continued)

*Primary Examiner* — Oyesola C Ojo
(74) *Attorney, Agent, or Firm* — McClure, Qualey & Rodack, LLP

(57) ABSTRACT

An amplifier and an electronic device using the same are provided. The amplifier includes a first speaker, a second speaker, an acoustic box and at least one partition. The first speaker and the second speaker are disposed on a continuous surface inside the acoustic box. The partition is disposed on the continuous surface and interposed between the first speaker and the second speaker.

14 Claims, 5 Drawing Sheets

(56) References Cited

U.S. PATENT DOCUMENTS

| | | | | |
|---|---|---|---|---|
| 7,496,207 | B2 * | 2/2009 | Borgonovo | H04R 5/02 381/334 |
| 8,682,008 | B2 * | 3/2014 | Tracy | H04R 1/026 381/182 |
| 8,699,743 | B2 * | 4/2014 | Moomey | H03F 3/183 381/345 |
| 2005/0271230 | A1 * | 12/2005 | Sasaki | H04R 1/403 381/333 |
| 2007/0154053 | A1 * | 7/2007 | Yang | H04M 1/035 381/386 |
| 2008/0130932 | A1 * | 6/2008 | Schultz | H04R 1/2857 381/337 |
| 2009/0127021 | A1 * | 5/2009 | Ting | H04R 1/2842 181/148 |
| 2010/0192756 | A1 * | 8/2010 | Kato | G10H 1/32 84/744 |
| 2013/0322672 | A1 * | 12/2013 | Wang | H04R 1/02 381/332 |
| 2015/0086056 | A1 * | 3/2015 | Ikuma | H04R 1/2819 381/335 |
| 2015/0172818 | A1 | 6/2015 | Gladwin et al. | |
| 2016/0014487 | A1 * | 1/2016 | Yang | H04R 1/2888 381/391 |

FOREIGN PATENT DOCUMENTS

| | | | | |
|---|---|---|---|---|
| CN | 203984641 U | | 12/2014 | |
| CN | 204014013 U | | 12/2014 | |
| CN | 204425601 U | | 6/2015 | |
| TW | M263708 U | | 5/2005 | |
| TW | 310548 | * | 4/2007 | H04R 5/02 |
| TW | M310548 U | | 4/2007 | |
| TW | M310548 U | * | 4/2007 | H04R 5/02 |
| TW | M532125 U | | 11/2016 | |

OTHER PUBLICATIONS

CN Office Action dated May 23, 2019 in Chinese application (No. 201610933007.8).

* cited by examiner

AMPLIFIER AND ELECTRONIC DEVICE USING THE SAME

This application claims the benefit of Taiwan application Serial No. 105119941, filed Jun. 24, 2016, the subject matter of which is incorporated herein by reference.

BACKGROUND OF THE INVENTION

Field of the Invention

The invention relates in general to an amplifier and an electronic device using the same, and more particularly to an amplifier using more than two speakers and an electronic device using the same.

Description of the Related Art

Along with the development in technology, new electronic devices are provided one after another. Some electronic devices are equipped with an amplifier to play music or sound effects. In the amplifier, a speaker is disposed in an acoustic box to generate a resonance frequency. To produce a better sound quality, the amplifier can be equipped with more than two speakers.

However, when more than two speakers are disposed inside the acoustic box, interference phenomenon would often be generated, and attenuation phenomenon may even occur at some frequency bands.

SUMMARY OF THE INVENTION

The invention relates to an amplifier and an electronic device using the same, which avoid more than two speakers interfering with each other inside an acoustic box through partition design.

According to one embodiment of the present invention, an amplifier is provided. The amplifier includes a first speaker, a second speaker, an acoustic box and at least one partition. The first speaker and the second speaker are disposed on a continuous surface inside the acoustic box. The partition is disposed on the continuous surface and interposed between the first speaker and the second speaker.

According to another embodiment of the present invention, an electronic device is provided. The electronic device includes an amplifier and an audio processing circuit. The amplifier includes a first speaker, a second speaker, an acoustic box and at least one partition. The first speaker and the second speaker are disposed on a continuous surface inside the acoustic box. The partition is disposed on the continuous surface and interposed between the first speaker and the second speaker. The audio processing circuit provides an audio signal to the amplifier.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
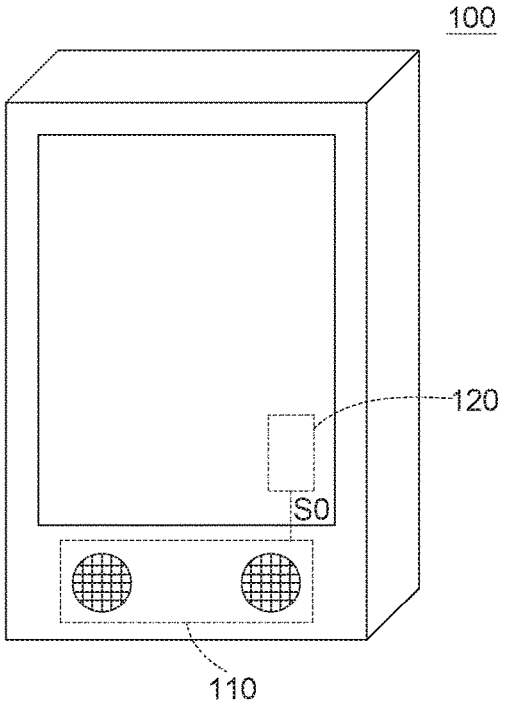
FIG. 1 is a schematic diagram of an electronic device according to an embodiment of the invention.

Referring to FIG. 1, a schematic diagram of an electronic device 100 according to an embodiment of the invention is shown. The electronic device 100 at least includes an amplifier 110 and an audio processing circuit 120. The audio processing circuit 120 provides an audio signal S0 to the amplifier 110. The electronic device 100 can be realized by such as a mobile phone, a laptop, a sound equipment, or a headset.

Figure 2:
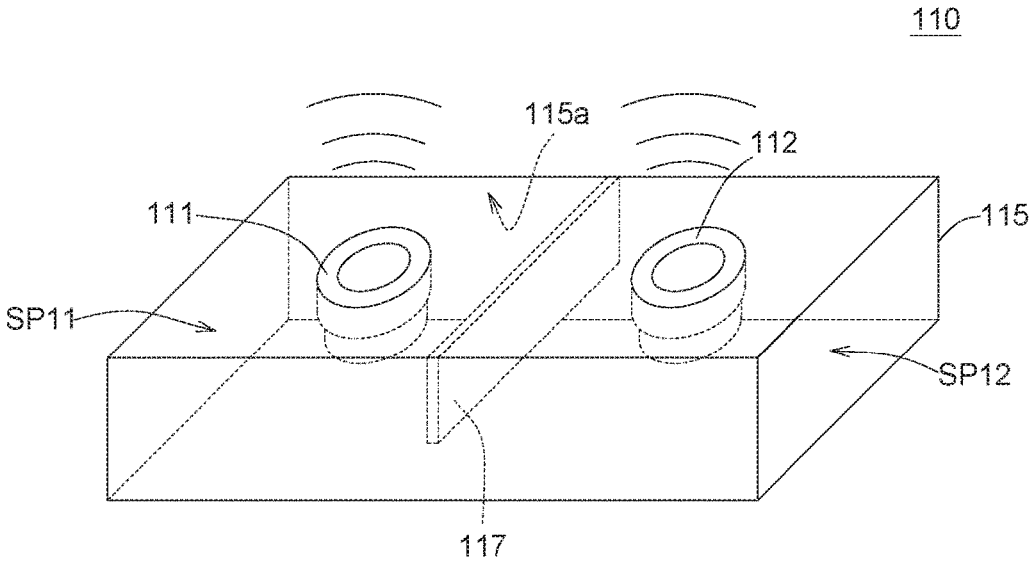
FIG. 2 is a 3D schematic diagram of the amplifier of FIG. 1.

Referring to FIG. 2, a 3D schematic diagram of the amplifier 110 of FIG. 1 is shown. The amplifier 110 includes a first speaker 111, a second speaker 112, an acoustic box 115 and a partition 117. The first speaker 111 and the second speaker 112 are disposed on a continuous surface 115*a* inside the acoustic box 115. The partition 117 is disposed on the continuous surface 115*a* and interposed between the first speaker 111 and the second speaker 112. Thus, the partition 117 divides the acoustic box 115 into two semi-connected spaces, namely, a first sub-space SP11 and a second sub-space SP12. The term "semi-connected" refers to arrangement that the first sub-space SP11 below the top of the first speaker 111 and the second speaker 112 and the second sub-space SP12 below the top of the first speaker 111 and the second speaker 112 are not connected, but the first sub-space SP11 above the top of the first speaker 111 and the second speaker 112 and the second sub-space SP12 above the top of the first speaker 111 and the second speaker 112 are connected. Thus, the vibration airflow of the first speaker 111 and the vibration airflow of the second speaker 112 do not interfere with each other.

Figure 3:
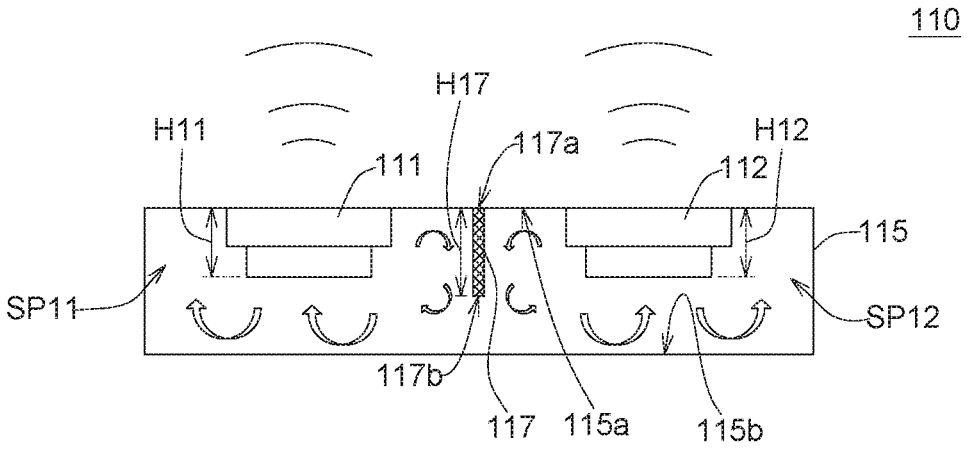
FIG. 3 is a side view of the amplifier of FIG. 2.

Referring to FIG. 3, a side view of the amplifier 110 of FIG. 2 is shown. As illustrated in the side-view diagram, the height H17 of the partition 117 is greater than the height H11 of the first speaker 111 and the height H12 of the second speaker 112, such that the first sub-space SP11 below the top of the first speaker 111 and the second speaker 112 and the second sub-space SP12 below the top of the first speaker 111 and the second speaker 112 are not connected. Besides, one end 117*a* of the partition 117 is connected to the continuous surface 115*a* and another end 117*b* of the partition 117 is separated from an opposite surface 115*b* facing the continuous surface 115*a* by a gap, such that the first sub-space SP11 above the top of the first speaker 111 and the second speaker 112 and the second sub-space SP12 above the top of the first speaker 111 and the second speaker 112 are connected.

Moreover, the partition 117 is disposed at a center between the first speaker 111 and the second speaker 112, such that the space between the first speaker 111 and the second speaker 112 can be evenly allocated to the first sub-space SP11 and the second sub-space SP12.

Furthermore, the partition 117 is a plate having an even thickness, and is substantially perpendicular to the continuous surface 115*a*, such that the partition 117 does not generate additional acute angular space which would other affect the resonance of the first speaker 111 or the second speaker 112.

In the present embodiment, the acoustic box 115 is a closed space, in which the two semi-connected spaces, namely, the first sub-space SP11 and the second sub-space SP12 are created. The partition 117 does not form any extra outlets or sound channels in the acoustic box 115.

Figure 4:
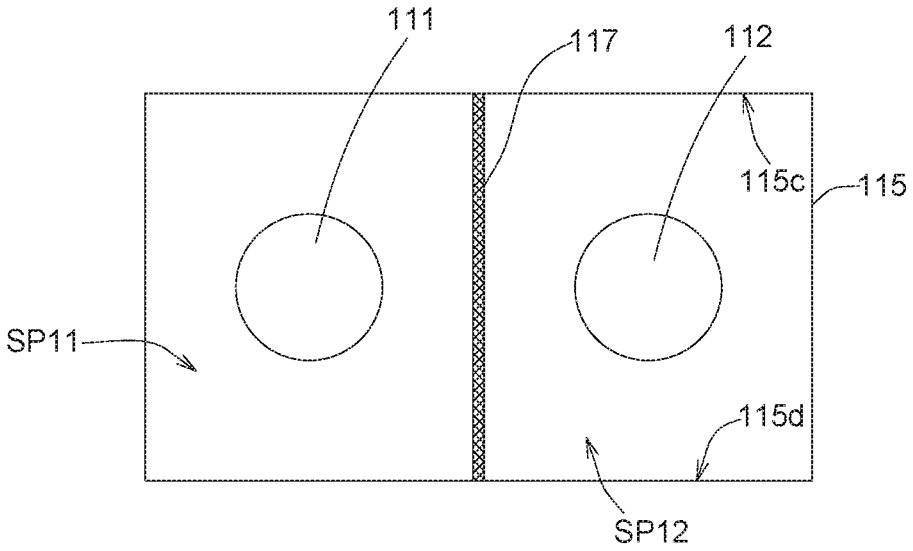
FIG. 4 is a top view of the amplifier of FIG. 2.

Referring to FIG. 4, a top view of the amplifier 110 of FIG. 2 is shown. The two sides of the partition 117 are tightly connected to two lateral surfaces 115*c* and 115*d* of the acoustic box 115, such that the first sub-space SP11 below the top of the first speaker 111 and the second speaker 112 and the second sub-space SP12 below the top of the first speaker 111 and the second speaker 112 are not connected under the height range of the first speaker 111 and the second speaker 112.

Figure 5:
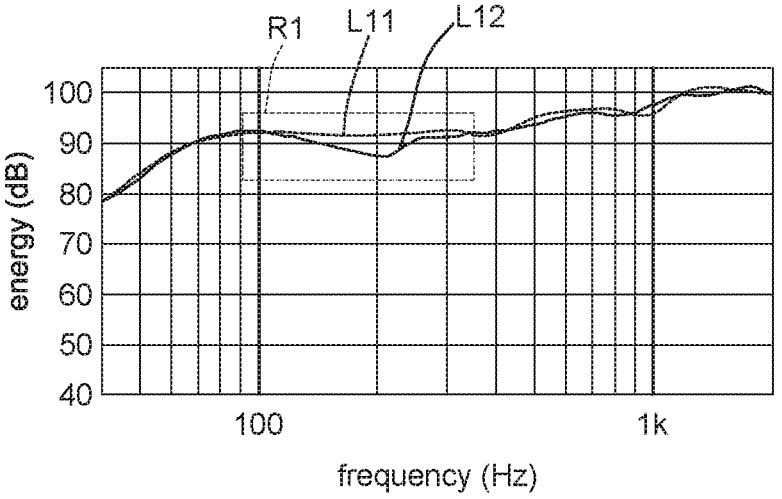
FIG. 5 is a frequency curve diagram based on experiments.

Referring to FIG. 5, a frequency curve diagram based on experiments is shown. In the present embodiment, a frequency curve L11 is obtained from the experiment results of the amplifier 110 using the partition 117; another frequency curve L12 is obtained from the experiment results of the amplifier (not illustrated) not using the partition. The experiment results show that the energy of the frequency curve L11 does not attenuate at range R1. That is, in the present embodiment, even when the first speaker 111 and the second speaker 112 do not vibrate synchronically due to the time delay of signal transmission, the vibration airflow of the first speaker 111 and the vibration airflow of the second speaker 112 still do not interfere with each other, and therefore energy does not attenuate.

Figure 6:
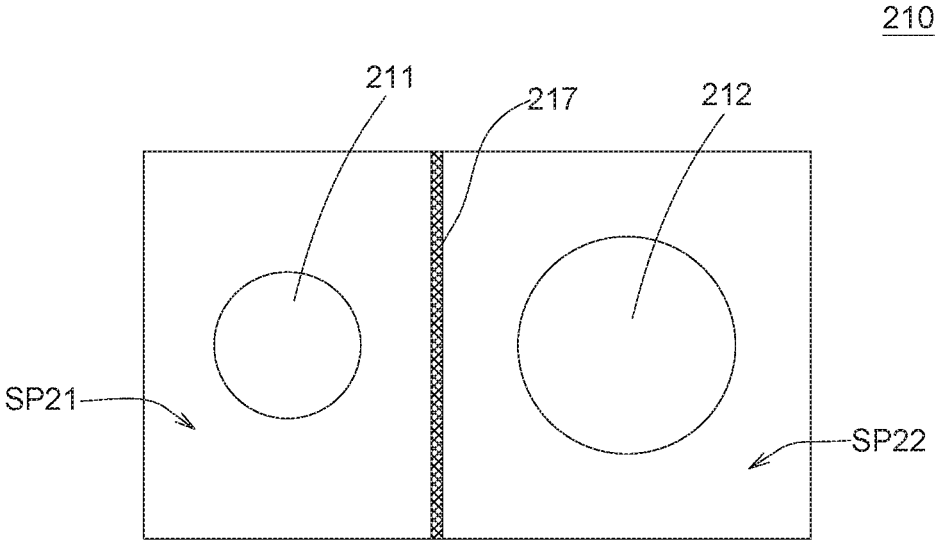
FIG. 6 is a top view of an amplifier according to another embodiment.

In the embodiment illustrated in FIG. 4, the first speaker 111 and the second speaker 112 substantially have the same size, but the invention is not limited thereto. Referring to FIG. 6, a top view of an amplifier 210 according to another embodiment is shown. In another embodiment, a first speaker 211 and a second speaker 212 of an amplifier 210 have different sizes. A partition 217 can be disposed at the center between the first speaker 211 and the second speaker 212, or can be disposed at a position closer to the first speaker 211 which is smaller than the second speaker 212. When the partition 217 is disposed at a position closer to the smaller first speaker 211, a first sub-space SP21 and a second sub-space SP22 can be formed according to the ratio of the first speaker 211 and the second speaker 212 to adjust the vibration energies of the first speaker 211 and the second speaker 212.

Figure 7:
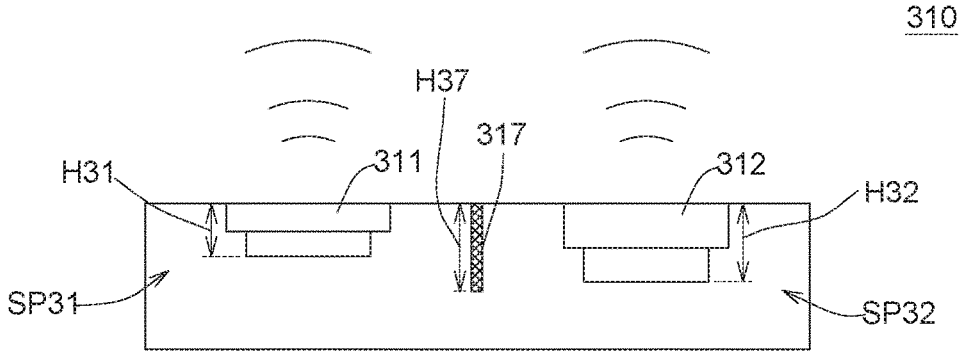
FIG. 7 is a side view of an amplifier according to another embodiment.

In the embodiment illustrated in FIG. 3, the first speaker 111 and the second speaker 112 have the same height, but the invention is not limited thereto. Referring to FIG. 7, a side view of an amplifier 310 according to another embodiment is shown. In another embodiment, a height H31 of a first speaker 311 of the amplifier 310 is different from a height H32 of a second speaker 312. A height H37 of a partition 317 is greater than the height H31 of the first speaker 311 and is also greater than the height H32 of the second speaker 312, such that a first sub-space SP31 below the top of the first speaker 311 and the second speaker 312 and a second sub-space SP32 below the top of the first speaker 311 and the second speaker 312 are not connected.

Figure 8:
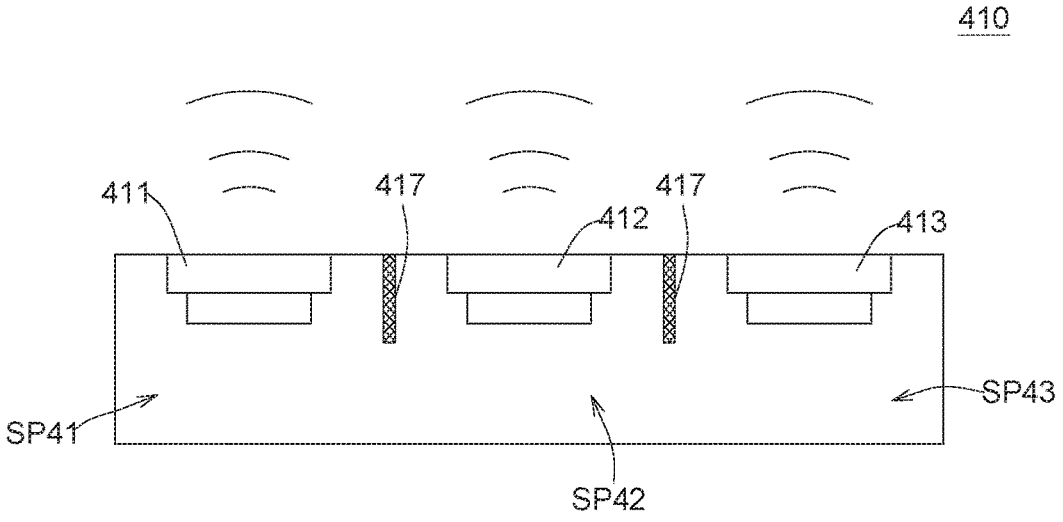
FIG. 8 is a side view of an amplifier according to another embodiment.
Figure 9:
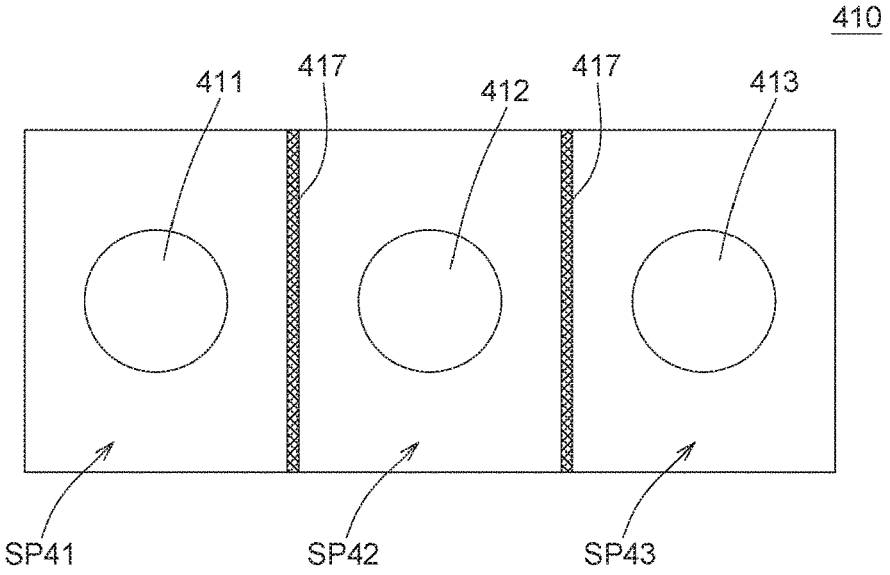
FIG. 9 is a top view of the amplifier of FIG. 8.

In above embodiments, the amplifiers 110, 210 and 310 are exemplified by two speakers, but the invention is not limited thereto. The quantity of speakers can be three, four, five or above. Refer to FIG. 8 and FIG. 9. FIG. 8 is a side view of an amplifier 410 according to another embodiment. FIG. 9 is a top view of the amplifier 410 of FIG. 8. In the present embodiment, the amplifier 410 includes a first speaker 411, a second speaker 412 and a third speaker 413. The quantity of partitions 417 is two. As indicated in FIG. 9, the first speaker 411, the second speaker 412 and the third speaker 413 are disposed substantially along a straight line. The partitions 417 are respectively interposed between the first speaker 411 and the second speaker 412 and between the second speaker 412 and the third speaker 413 to form a first sub-space SP41, a second sub-space SP42 and a third sub-space SP43 which are semi-connected to each other. The first sub-space SP41 below the top of the first speaker 411, the second speaker 412 and the third speaker 413, the second sub-space SP42 below the top of the first speaker 411, the second speaker 412 and the third speaker 413 and the third sub-space SP43 below the top of the first speaker 411, the second speaker 412 and the third speaker 413 are not connected; but the first sub-space SP41 above the top of the first speaker 411, the second speaker 412 and the third speaker 413, the second sub-space SP42 above the top of the first speaker 411, the second speaker 412 and the third speaker 413 and the third sub-space SP43 above the top of the first speaker 411, the second speaker 412 and the third speaker 413 are connected. Thus, the vibration airflow of the first speaker 411, the vibration airflow of the second speaker 412 and the vibration airflow of the third speaker 413 do not interfere with each other.

Figure 10:
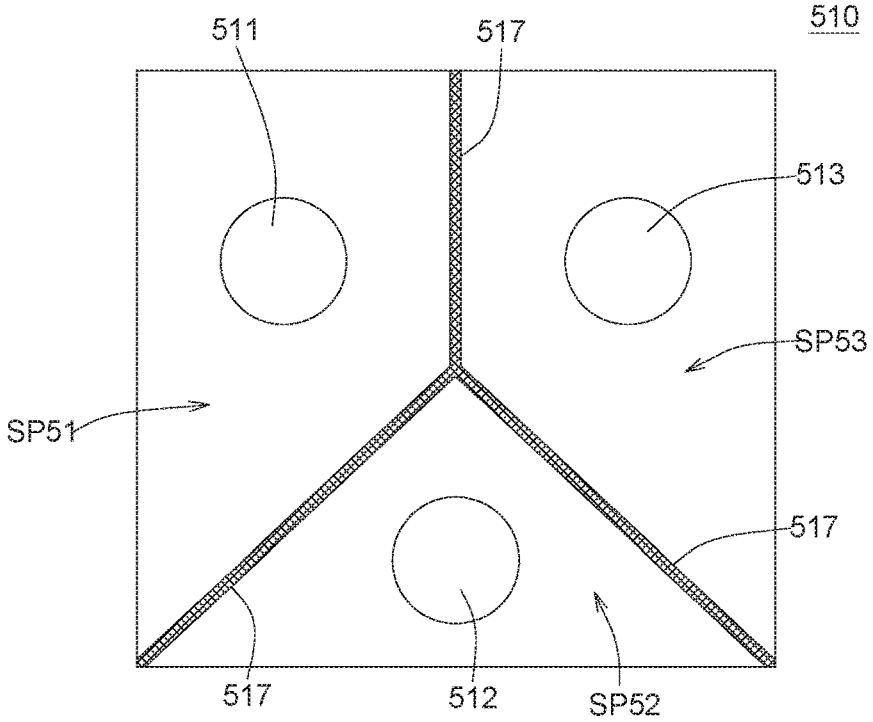
FIG. 10 is a top view of an amplifier according to another embodiment.

The first speaker 411, the second speaker 412 and the third speaker 413 are substantially disposed along a straight line, but the invention is not limited thereto. Referring to FIG. 10, a top view of an amplifier 510 according to another embodiment. In the present embodiment, the amplifier 510 includes a first speaker 511, a second speaker 512 and a third speaker 513. The quantity of partitions 517 is three. The connection lines of the first speaker 511, the second speaker 512 and the third speaker 513 form a triangle. The partitions 517 are respectively interposed between the first speaker 511 and the second speaker 512, between the second speaker 512 and the third speaker 513, and between the third speaker 513 and the first speaker 511, such that the partitions 517 are connected to form a Y-shaped structure. The partitions 517 form a first sub-space SP51, a second sub-space SP52 and a third sub-space SP53 which are semi-connected to each other. The first sub-space SP51 below the top of the first speaker 411, the second speaker 412 and the third speaker 413, the second sub-space SP52 below the top of the first speaker 411, the second speaker 412 and the third speaker 413 and the third sub-space SP53 below the top of the first speaker 411, the second speaker 412 and the third speaker 413 are not connected, but the first sub-space SP51 above the top of the first speaker 411, the second speaker 412 and the third speaker 413, the second sub-space SP52 above the top of the first speaker 411, the second speaker 412 and the third speaker 413 and the third sub-space SP53 above the top of the first speaker 411, the second speaker 412 and the third speaker 413 are connected. Thus, the vibration airflow of the first speaker 511, the vibration airflow of the second speaker 512 and the vibration airflow of the third speaker 513 do not interfere with each other.

In the embodiments disclosed above, through the design of partition(s), the amplifier and electronic device using the same avoid more than two speakers inside the acoustic box interfering with each other. The results of experiment show that the partition can effectively avoid energy attenuation of the frequency curve at a particular frequency band.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An amplifier, comprising:

a first speaker;

a second speaker;

a third speaker;

an acoustic box, wherein the first speaker, the second speaker and the third speaker are disposed on a continuous surface inside the acoustic box; and three partitions disposed on the continuous surface, one of the partitions is interposed between the first speaker and the second speaker, another one of the partitions is interposed between the second speaker and the third speaker, and another one of the partitions is interposed between the third speaker and the first speaker;

wherein one end of each partition is connected to the continuous surface where the first speaker, the second speaker and the third speaker are disposed, and another end of the partition is separated from an opposite surface facing the continuous surface by a gap;

wherein three connection lines of the first speaker, the second speaker and the third speaker form a triangle, and the partitions are connected to form a Y-shaped structure.

2. The amplifier according to claim 1, wherein a height of the partition is greater than a height of the first speaker and a height of the second speaker.

3. The amplifier according to claim 1, wherein the partition is disposed at a center between the first speaker and the second speaker.

4. The amplifier according to claim 1, wherein the partition is substantially perpendicular to the continuous surface.

5. The amplifier according to claim 1, wherein the partition has an even thickness.

6. The amplifier according to claim 1, further comprising a third speaker, wherein a quantity of the at least one partition is two, the first speaker, the second speaker and the third speaker are disposed substantially along a straight line, one of the partitions is interposed between the first speaker and the second speaker, and another one of the partitions is interposed between the second speaker and the third speaker.

7. The amplifier according to claim 1, wherein the first speaker and the second speaker have different sizes.

8. An electronic device, comprising:

an amplifier, comprising:

a first speaker;

a second speaker;

a third speaker;

an acoustic box, wherein the first speaker, the second speaker and third speaker are disposed on a continuous surface inside the acoustic box; and three partitions disposed on the continuous surface, one of the partitions is interposed between the first speaker and the second speaker, another one of the partitions is interposed between the second speaker and the third speaker, and another one of the partitions is interposed between the third speaker and the first speaker;

wherein one end of each partition is connected to the continuous surface where the first speaker, the second speaker and the third speaker are disposed, and another end of each partition is separated from an opposite surface facing the continuous surface by a gap;

wherein three connection lines of the first speaker, the second speaker and the third speaker form a triangle, and the partitions are connected to form a Y-shaped structure; and an audio processing circuit for providing an audio signal to the amplifier.

9. The electronic device according to claim 8, wherein a height of the partition is greater than a height of the first speaker and a height of the second speaker.

10. The electronic device according to claim 8, wherein the partition is disposed at a center between the first speaker and the second speaker.

11. The electronic device according to claim 8, wherein the partition is substantially perpendicular to the continuous surface.

12. The electronic device according to claim 8, wherein the partition has an even thickness.

13. The electronic device according to claim 8, wherein the amplifier further comprises a third speaker, a quantity of the at least one partition is two, the first speaker, the second speaker and the third speaker are disposed substantially along a straight line, one of the partitions is interposed between the first speaker and the second speaker, and another one of the partitions is interposed between the second speaker and the third speaker.

14. The electronic device according to claim 8, wherein the first speaker and the second speaker have different sizes.

* * * * *